US006453640B1

(12) United States Patent
Hayashi

(10) Patent No.: US 6,453,640 B1
(45) Date of Patent: Sep. 24, 2002

(54) BAG BINDING MACHINE

(75) Inventor: Susumu Hayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 85 days.

(21) Appl. No.: 09/627,303

(22) Filed: Jul. 27, 2000

(30) Foreign Application Priority Data

Jul. 28, 1999 (JP) ..... 11-214155

(51) Int. Cl.[7] ..... B65B 51/04
(52) U.S. Cl. ..... 53/138.3; 53/583
(58) Field of Search ..... 53/138.3, 138.4, 53/139.1, 583

(56) References Cited

U.S. PATENT DOCUMENTS 3,099,116 A * 7/1963 Platt et al. ..... 53/138.3
3,668,818 A * 6/1972 Holmes ..... 53/138.3
5,485,711 A * 1/1996 Suzuki et al. ..... 53/138.4
6,098,370 A * 8/2000 Kobayashi et al. ..... 53/138.3

FOREIGN PATENT DOCUMENTS

JP A-02000-255524 9/2000

* cited by examiner

*Primary Examiner*—John Sipos
(74) *Attorney, Agent, or Firm*—Morgan, Lewis & Bockius LLP

(57) ABSTRACT

A bag binding machine for binding a bag with a binding clip comprising a binding portion, a handle, a carrier, a feed unit, a crimping unit, and a delayer. The carrier is reciprocatively movable to the binding portion by an operation of the handle. The feed unit is provided on the carrier, and the feed unit includes a holding portion for holding the binding clip and a crossing portion for crossing leg portions of the binding clip. The crimping unit is disposed in a side opposite to the feed unit, and the crimping unit includes crimping mechanism for crimping the crossed leg portions of the binding clip. The delayer connects the carrier to the crimping unit for transmitting reciprocating movement of the carrier to the crimping unit in a delayed manner.

2 Claims, 7 Drawing Sheets

BAG BINDING MACHINE

BACKGROUND OF THE INVENTION

1. Field of the Invention

The present invention relates to a bag binding machine, especially, to a hand-operated bag binding machine.

2. Description of the Related Art

As a bag opening binding machine of this type, conventionally, there is known a bag opening binding machine structured such that, after the opening portion of a bag to be bound is moved to and arranged in a binding portion, a U-shaped clip formed of synthetic resin is inserted into the binding portion, the leg pieces of the two legs of the clip are made to cross each other, and the crossed portions of the leg pieces are crimped to thereby bind the bag opening portion. The conventional bag opening binding machine is a type that it can be worked by an electric motor. However, the conventional bag opening binding machine of a motor-operated type is complicated in structure and is large in size as well as the manufacturing cost thereof is high. Therefore, there has been increasing the need for development of a bag opening binding machine which can be worked by hand and is simple in structure.

As a bag opening binding machine which can cope with the above increasing need, there can be expected a hand-operated bag opening binding machine which can carry out three operations, namely, a clip feeding operation, a leg pieces crossing operation and a crimping operation by means of manual operation of a handle. That is, there maybe employed a structure in which the above three operations can be carried out sequentially when the handle is driven in one direction, and, by driving the handle in the opposite direction, the reversed operations are carried out to thereby return the binding machine back to its initial position. According to this reciprocating operation, after the crimping operation is completed, the crimping operation, the leg pieces crossing operation, and the clip feeding operation are sequentially released in this order.

However, in the above structure, there is a possibility that, while the leg pieces crossing operation or the clip feeding operation is being released, the clip itself can be caught on any one of its peripheral parts after completion of the crimping operation. Therefore, in case where the leg pieces crossing operation and the clip feeding operation are released after the crimping operation is released on ahead, there is a fear that the crimping may be removed when the leg pieces or clip itself are caught on any one of its peripheral parts.

SUMMARY OF THE INVENTION

The present invention aims at eliminating the above drawbacks found in the conventional bag opening binding machine. Accordingly, it is an object of the invention to provide a hand-operated bag binding machine which can prevent the crimping from being removed.

In attaining the above object, according to the invention, there is provided a bag binding machine, comprising: a binding portion disposed in the leading end of a guide passage for guiding the opening portion of a bag; a feed unit holding a binding clip formed in a gate shape and including crossing mechanism capable of making the leg pieces of the clip cross each other in such a manner that the opening portion of the bag is taken in between through the leg pieces; and, a crimping unit disposed on the opposite side to the feed unit with the binding portion between them for crimping the leading ends of the clip leg pieces crossed. The feed unit is disposed on a carrier which can be reciprocated by operating a handle so that the feed unit can be moved to the binding portion. The carrier is connected through delayer to a crimping mechanism so that the reciprocating motion of the carrier can be transmitted to a crimping mechanism in a delayed manner. In linking with the forward motion of the carrier, the feed unit is fed to the binding portion to thereby operate the crossing mechanism; then, the crimping mechanism is operated by the delayer. On the other hand, in the backward motion of the carrier, at first, operations to release the operation of the crossing mechanism of the feed unit and to return the same to its initial position are carried out ; then, the crimping operation of the crimping unit is removed by the delayer.

DETAILED DESCRIPTION OF THE PREFERRED EMBODIMENT

Figure 1:
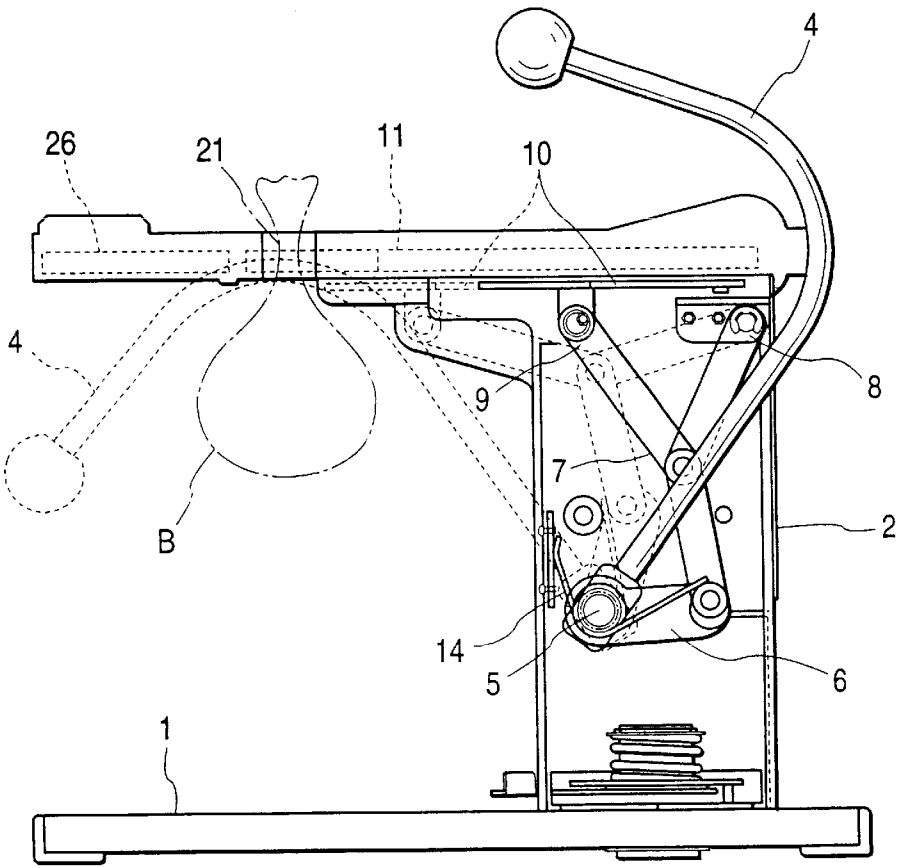
FIG. 1 is a side view of the outline of a hand-operated bag binding machine according to the invention.
Figure 2:
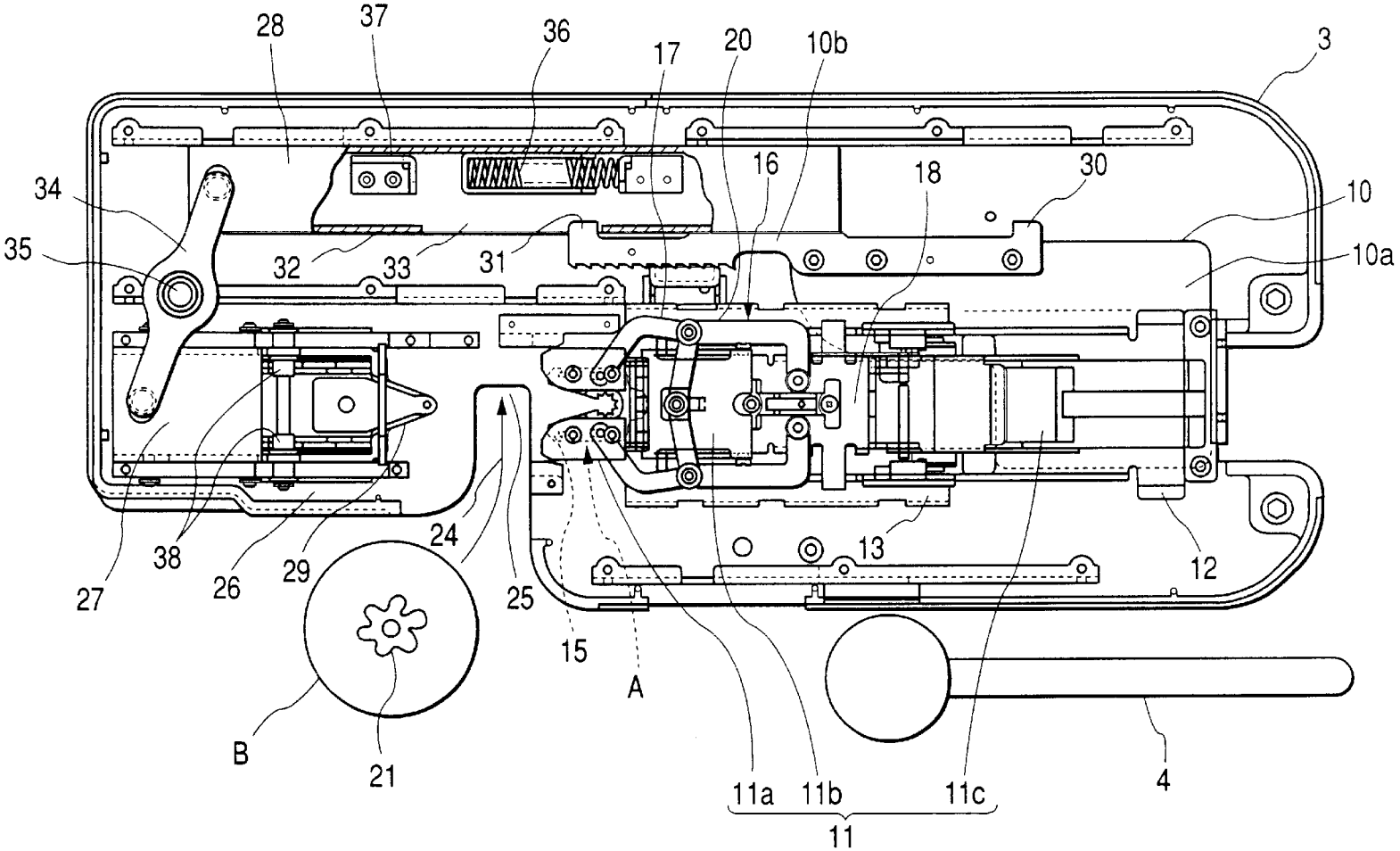
FIG. 2 is a plan view of the hand-operated bag binding machine shown in FIG. 1.

Now, FIG. 1 is a side view of the outline of a hand-operated bag binding machine according to the invention, and FIG. 2 is a plan view of the hand-operated bag binding machine shown in FIG. 1. In FIGS. 1 and 2, reference character 1 designates a base; 2, a support; 3, a main body of the bag binding machine; and 4, a handle; respectively. The base end of the handle 4 is supported on a rotary shaft 5 which is disposed in the support 2, a first link 6 is fixed to the rotary shaft 5, and the first link 6 is further connected to a link 7 which is formed in Y-shape. One end portion 8 of the forked portion of the Y-shaped link 7 is fixed to the support 2, while the other end portion 9 thereof is connected to a carrier 10. Also, on the rotary shaft 5, there is mounted a torsion coil spring 14 which normally energizes the handle 4 such that the handle 4 can be held at an initial position shown by a solid line in FIG. 1 .

The carrier 10 is composed of a carrier main body 10*a* and a carrier bar 10*b* disposed on one side thereof, while the carrier 10 is disposed on the binding machine main body 3 in such a manner that it can be moved back and forth in a given range. That is, at the rear end of the carrier main body 10*a*, there is provided a projecting piece 12 which projects outwardly; and, the carrier 10 is structured such that it is able to move back and forth between its initial position shown in FIG. 2 and a position at which the projecting piece 12 can be engaged with the rear end portion of a guide rail 13.

Figure 3:
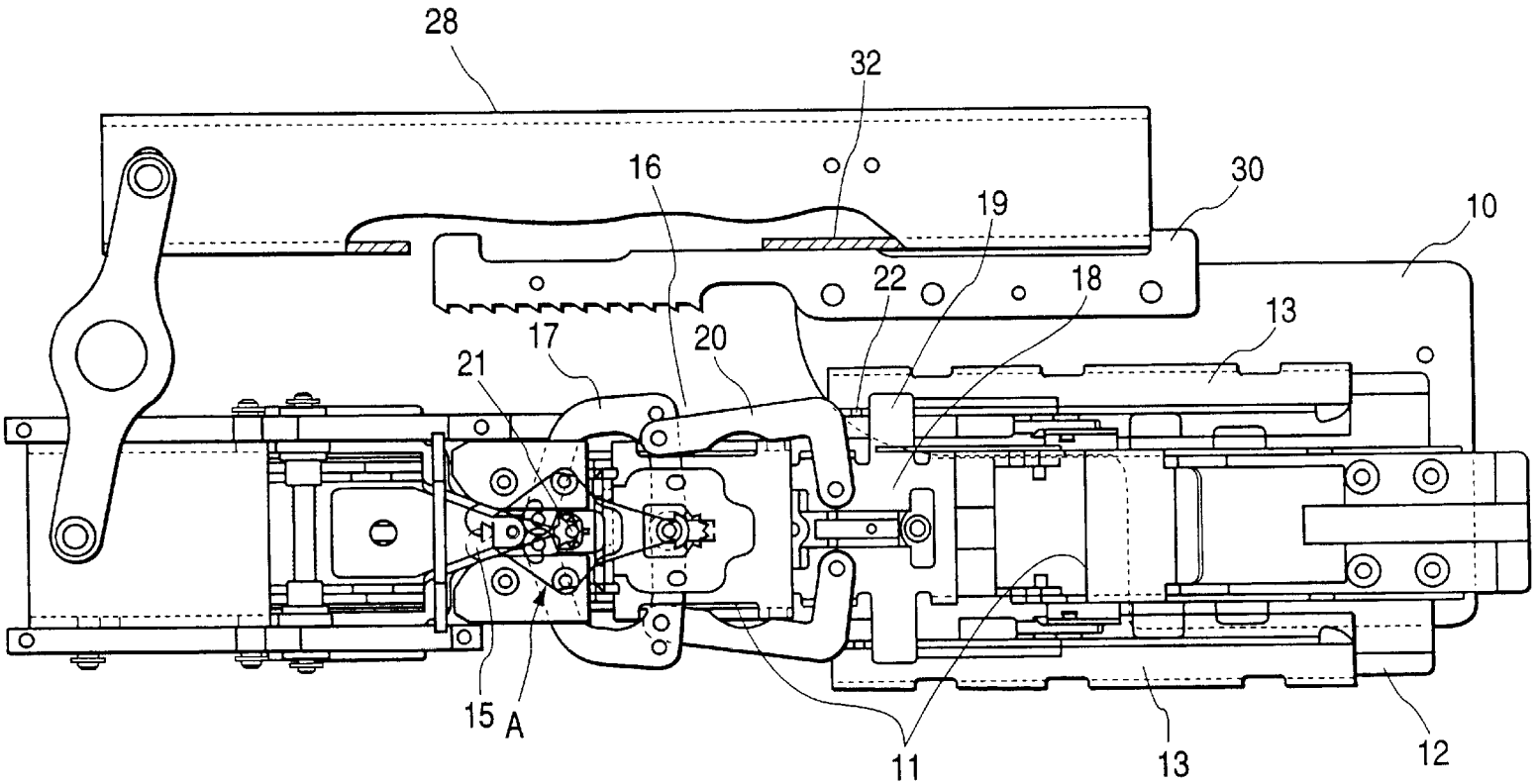
FIG. 3 is a plan view of above the hand-operated bag binding machine, showing a state in which a feed unit is fed to a binding portion in the forward motion of a carrier.

On the carrier main body 10*a*, there is disposed a feed unit 11 in such a manner that it can be moved back and forth in a given range. The feed unit 11 comprises a hold portion 11*a* for holding a clip, an operation link support portion 11*b* for crossing, a rear end portion 11*c*, and an operation plate 18. The hold portion 11*a*, as shown in FIG. 3, is formed such that it can hold the leg pieces 15 of the first clip a of connected clips. On the operation link support portion 11*b* for crossing, there is supported an operation link 17 in such a manner that it can be rotated, while the operation link 17 is connected to a pair of L-shaped links 20 respectively journaled on the operation plate 18 to thereby form crossing mechanism 16. The operation plate 18 is structured such that it can be operated in linking with the carrier 10 in a different range from the remaining components of the feed unit 11 and at a timing different from that of these remaining components. A pin (not shown) disposed at the leading end of the operation link 17 is formed such that it can be engaged with an engaging hole 23 (see FIG. 8) formed in the leg piece 15 of the clip A. Further, the operation plate 18 is structured such that, after the forward motion of the feed unit 11 is stopped, it can be engaged with the carrier 10 to thereby operate the L-shaped link 20.

Figure 8:
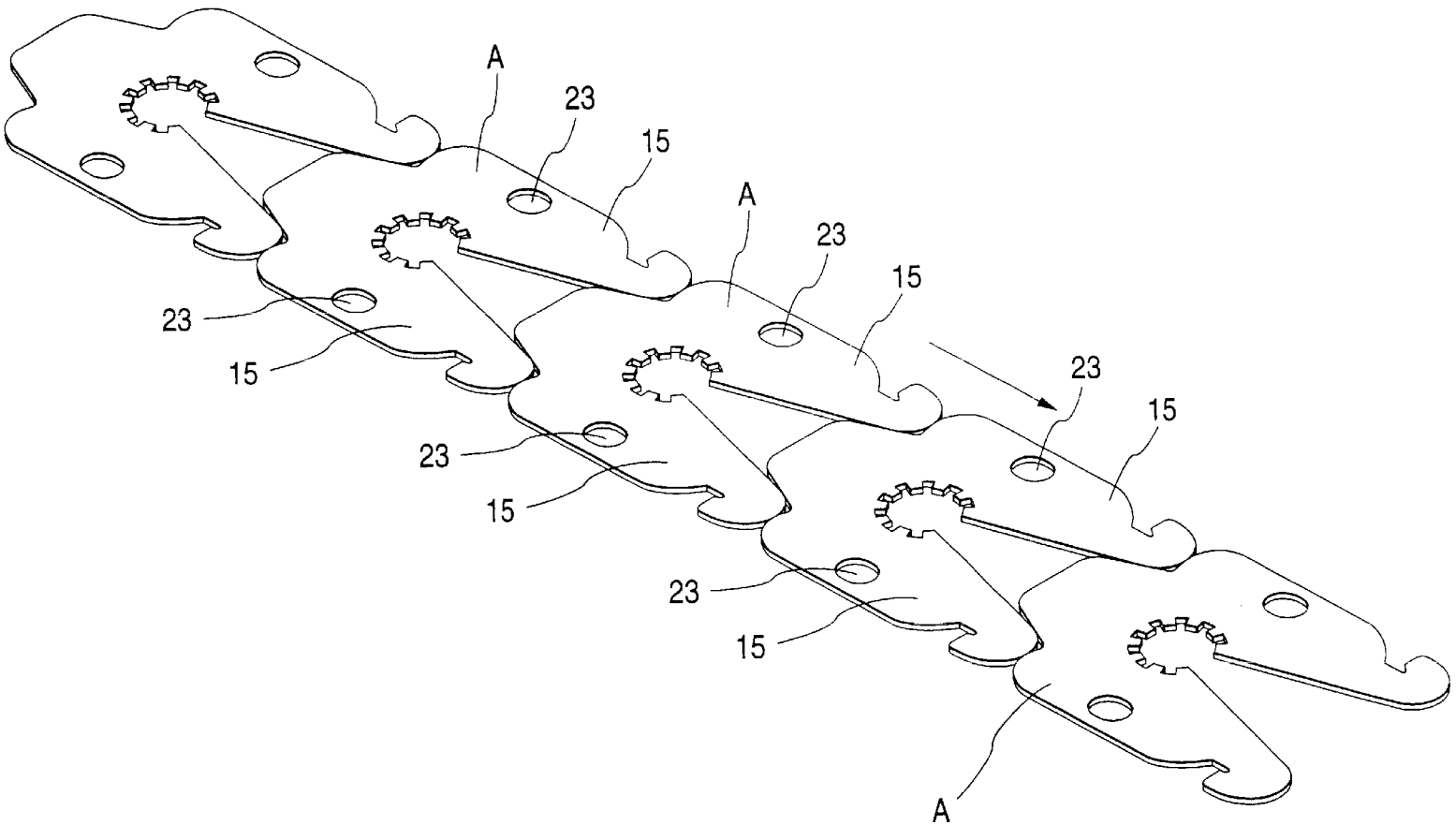

In the above hand-operated bag binding machine, as shown in FIG. 8, there are used connected clips composed of a large number of binding clips A which are connected together in a tape-like manner. However, in the present embodiment, only part of the connected clips are shown.

In the binding machine main body 3, there is formed a guide passage 24 which is used to guide the opening portion 21 of a bag B, and, at the leading end of the guide passage 24, there is formed a binding portion 25.

Next, there is disposed a crimping unit 26 on the side opposite to the feed unit 11 with the binding portion 25 between them. This crimping unit 26 is structured such that a roller 38 disposed on a driver plate 27 moves to the binding portion 25 side to thereby crimp the leading ends of the crossed leg pieces 15 of the clip A. After crimped, there is obtained a state shown in FIG. 6 but the detailed description of the crimping mechanism of the crimping unit 26 is omitted here. As a related art, this kind of crimping unit is shown, for example, in FIG. 3 of Japanese Patent Application No. Hei. 11-067452.

The carrier 10 is connected through delayer 28 to a crimping mechanism 29. That is, on the two ends of the carrier bar 10*b* connected to the side portion of the carrier 10, there are provided projecting portions 30, 31. On the side portion of the carrier bar 10*b*, there is disposed the opened gate-shaped delayer 28 in such a manner that it can be moved in parallel to the carrier 10. One leg portion 32 of the delayer 28 is cut away, while the front-side projecting portion 31 of the carrier bar 10*b* is inserted into the cut-away portion 33 in such a manner that one leg portion 32 can be engaged with the cut-away portion 33. Further, the front end portion of the delayer 28 and the above-mentioned driver plate 27 are connected together by a link 34. The central portion of the link 34 is rotatably supported by a support shaft 35.

On the back side of the delayer 28, there is disposed a compression spring 36 and, in front of the compression spring 36, there is disposed a spring receiver 37.

Next, description will be given below of the operation of the above-structured bag binding machine. As shown in FIG. 2, after the opening portion 21 of the bag B with vegetables, bread or the like stored therein is inserted from the guide passage 24 of the binding machine main body 3 into the binding portion 25, in case where the handle 4 is operated and turned in one direction, at first, the feed unit 11 is moved forward together with the carrier 10, while the clip A held by the hold portion 15 of the leading end portion of the feed unit 11 is fed into the binding portion 25. At this time, as shown in FIG. 3, the projecting piece 12 of the feed unit 11 is engaged with the rear end portion of the guide rail 13, so that the forward motion of the feed unit 11 is caused to stop. In cases where the handle 4 is turned on further, the carrier 10 is moved forward and, with the forward motion of the carrier 19, the operation plate 18 is also moved forward, thereby operating the crossing mechanism 16. That is, the operation plate 18 presses against the L-shaped link 20 to thereby operate the operation link 17 such that the leading ends of the operation link 17 approach each other, so that the pin of the operation link 17 makes the leg pieces 15 of the clip a cross each other. Two projecting pieces 19, which are respectively provided on the two sides of the operation plate 18, are engaged with the engaging projecting portions 22 of the guide rail 13, with the result that the projecting pieces 19 are prevented from moving forward any further.

Figure 4:
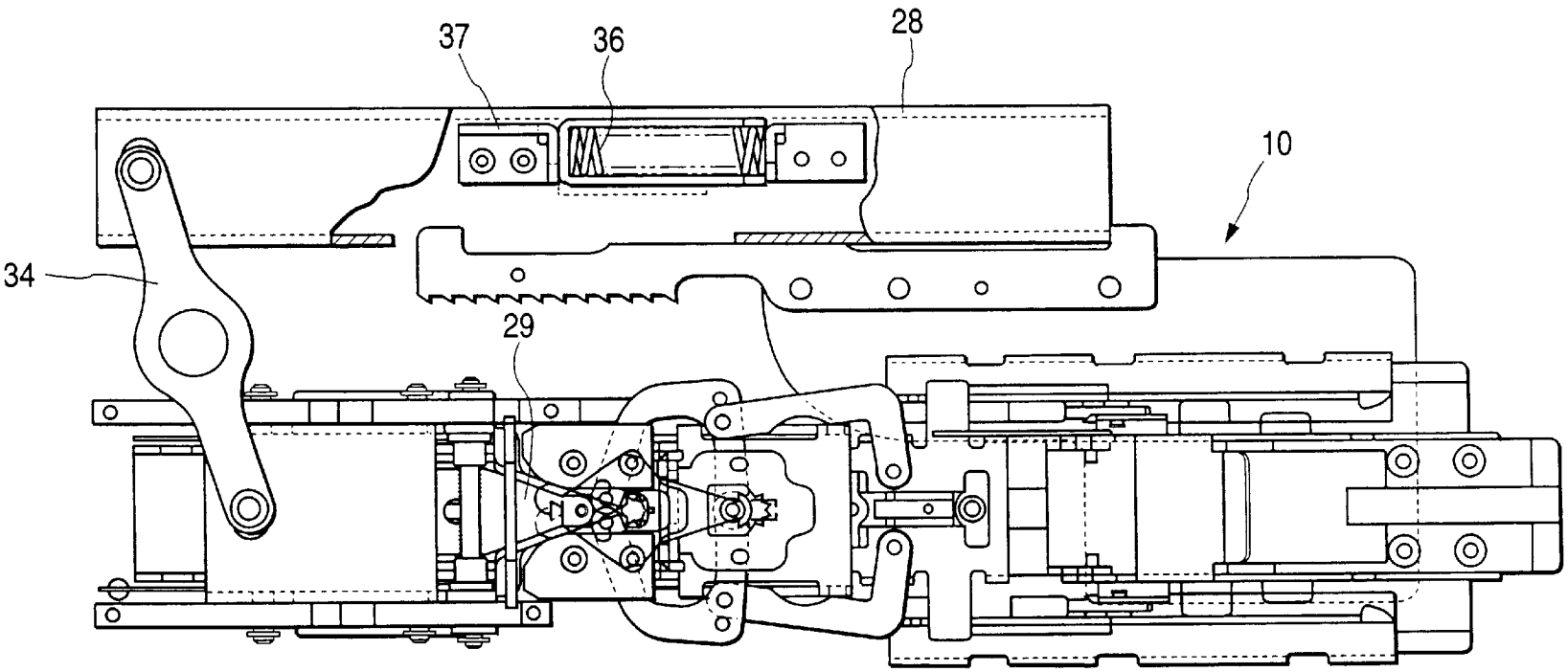
FIG. 4 is a plan view of above the hand-operated bag binding machine, showing a state in which a crimping unit is operated in the forward motion of the carrier.

Just before an operation to make the leg pieces 15 of the clip A cross each other in the above-mentioned manner is executed, the rear-end projecting portion 30 of the carrier bar 10*b* of the carrier 10 is engaged with the rear end of the leg portion 32 of the delayer 28 and, therefore, in linking with the forward motion of the carrier 10, the delayer 28 is moved forward. Due to this, as shown in FIG. 4, the link 34 is oscillated about the support shaft 35 to thereby move the driver plate 27 of the crimping unit 26 in the opposite direction, so that the crimping mechanism 29 is operated and thus the crossed leg pieces 15 are crimped to thereby stop the operation of the handle 4. At the same time, the compression spring 36 of the delayer 28 is engaged with and pressed by the spring receiver 37, so that the compression spring 36 is turned into a compressed state. Similarly, the torsion coil spring 14 of the handle 4 is also held in a flexed state.

Figure 5:
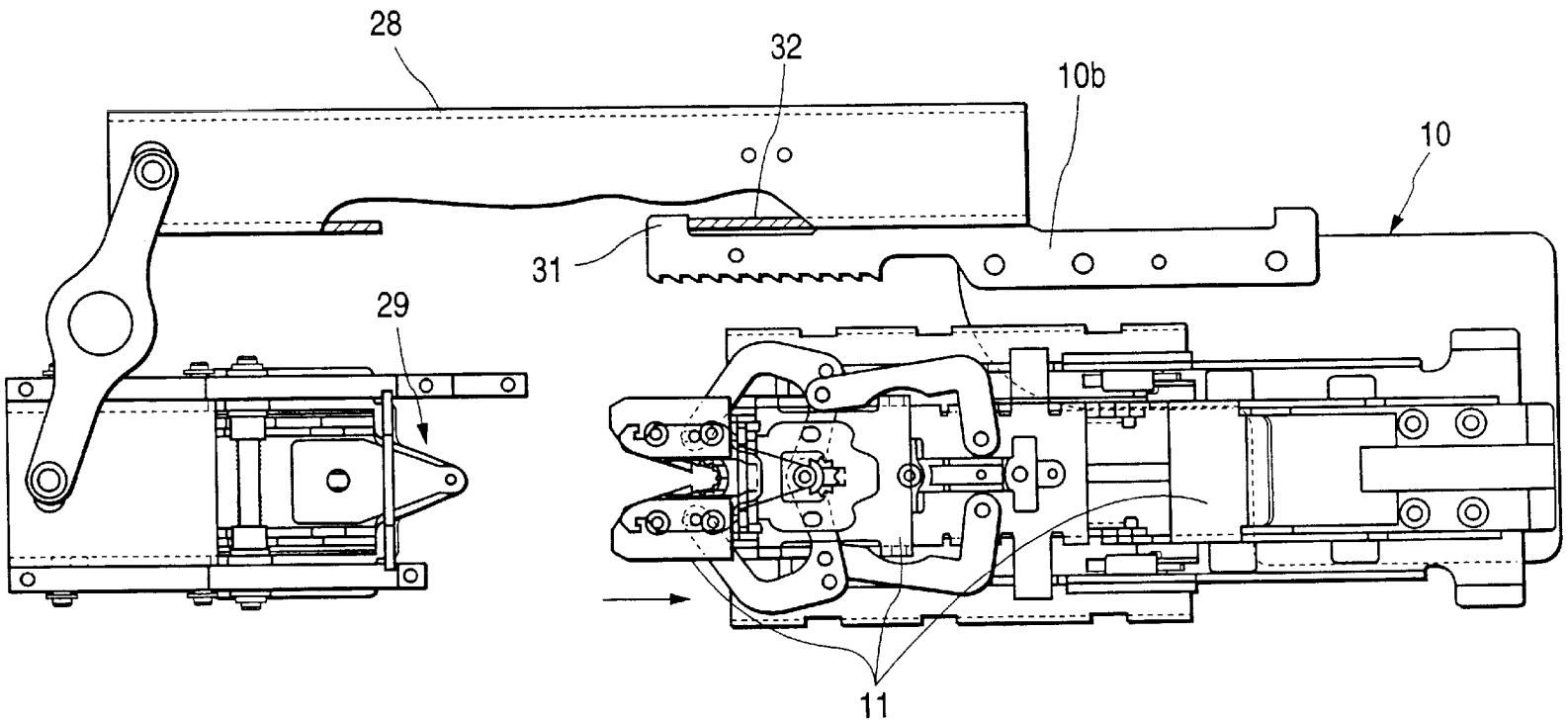
FIG. 5 is a plan view of above the hand-operated bag binding machine, showing its operation state in the backward motion of the carrier.
Figure 6:
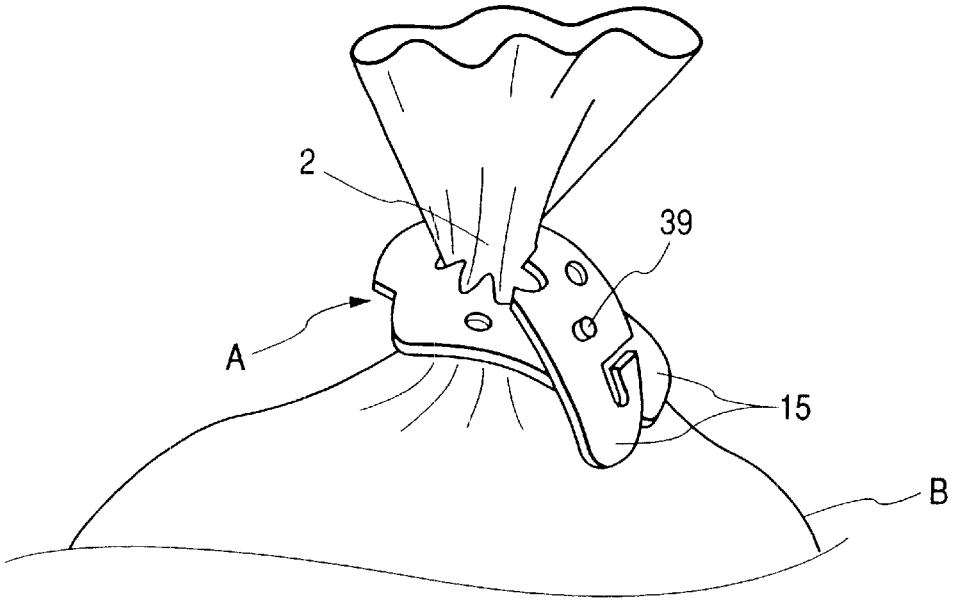
FIG. 6 is a perspective view of a bag, showing a state in which the opening portion thereof has been bound.

After completion of the crimping operation, in cases where the force applied to the handle 4 is released, the compression force applied to the compression spring 36 as well as the spring force of the torsion coil spring 14 of the handle 4 are released, so that the delayer 28 is firstly moved only slightly in the opposite (backward) direction with a light force. At this time, the crimped state is still maintained. Further, in cases where the handle 4 is turned in the opposite direction, the carrier 10 is also moved backward. Due to this, oppositely to the above case, the operation plate 18 causes the crossing mechanism 16 to release the crossing operation, and further it retreats the feed unit 11 from the binding portion 25 so that, as shown in FIG. 5, the feed unit 11 is caused to return to its initial position. On the way back to the initial position, the front-end projecting portion 31 of the carrier bar 10*b* of the carrier 10 is engaged with the leg portion 32 of the delayer 28, and thus the delayer 28 is operated to thereby release the crimping operation of the crimping mechanism 29. Finally, the feed unit 11 returns to the initial position; then, the bag B with the opening portion thereof bound may be discharged from the guide passage 24. FIG. 6 shows a state of the bag B in which the opening portion 21 thereof has been bound by the clip A.

Figure 7:
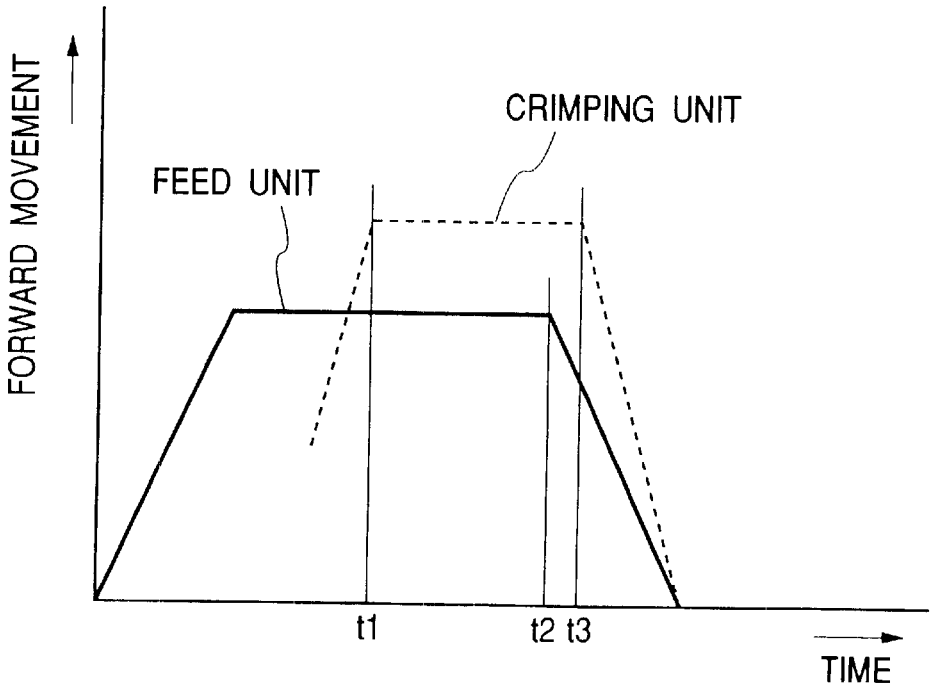
FIG. 7 is a graphical representation of the operation timings of the feed unit and crimping unit; and, FIG. 8 is a partially perspective view of connected clips.

FIG. 7 illustrates the above-mentioned operation. When the carrier 10 is moved forward in the above-mentioned manner, the leading end hold portion 11*a* of the feed unit 11 is fed to the binding portion 25 to operate the crossing mechanism 16. Then, the crimping mechanism 29 is operated by the delayer 28. On the other hand, when the feed unit 11 is moved backward after the crimping operation is finished at a timing t1, the unit 11 is firstly moved backward and retreated from the clip A by the carrier 10 at a timing t2;

then, the crimping operation of the crimping mechanism 29 of the crimping unit 26 is released at a timing t3 by the delayer 28. In this manner, since the crimping operation by the crimping mechanism 29 is not released when the feed unit 11 starts its backward motion, the crimped condition of the clip a can be maintained properly. Therefore, even in a hand-operated bag binding machine using the reciprocating motion of the handle 4, the crimped condition of the clip can be kept well until the bag B is taken out after completion of the binding operation of the bag opening portion, which makes it possible to prevent the poor bound condition of the bag opening portion effectively.

The delayer for transmitting the operation of the carrier 10 to the crimping unit in a delayed manner is not limited to the above-mentioned delayer having a gate-shaped section. It is also possible to use the delayer that is conventionally known.

While only a certain embodiment of the invention has been specifically described herein, it will be apparent that numerous modifications may be made thereto without departing from the spirit and scope of the invention.

What is claimed is:

1. A bag binding machine for binding a bag with a binding clip including leg portions, said machine comprising:

a binding portion provided in a guide passage for guiding an opening portion of the bag;

a handle;

a carrier reciprocatively movable to said binding portion by an operation of said handle;

a feed unit provided on said carrier, said feed unit including a holding portion for holding the binding clip and a crossing portion for crossing the leg portions of the binding clip;

a crimping unit disposed in a side opposite to said feed unit, said crimping unit including crimping mechanism for crimping the crossed leg portions of the binding clip; and a delayer connecting said carrier to said crimping unit for transmitting reciprocating movement of said carrier to said crimping unit in a delayed manner, wherein, in a forward movement of said carrier, said feed unit is fed from an initial position to said binding portion to thereby operate the crossing portion of said feed unit before a crimping operation of said crimping unit is operated via said delayer, and wherein, in a backward motion of said carrier, the operation of said crossing portion of said feed unit is released and said feed unit is returned to the initial position before the crimping operation of said crimping unit is released via said delayer.

2. The bag binding machine according to claim 1, further comprising a carrier bar connected to said carrier and including first and second projecting portions, wherein said delayer including a leg portion having a cut-away portion in which the first projecting portion of said carrier bar is inserted, and wherein the second projecting portion of said carrier bar is engaged with the outer edge of the leg portion of said delayer in order to operate said crimping unit after the crossing operation of the crossing portion of said feed unit is started, and wherein the first projecting portion of said carrier bar is engaged with the inner edge of the cut-away portion of the leg portion of said delayer in order to release the crimping operation of said crimping unit after the crossing operation of the crossing portion of said feed unit is released.

* * * * *